US009135871B2

(12) United States Patent
Nose et al.

(10) Patent No.: US 9,135,871 B2
(45) **Date of Patent: *Sep. 15, 2015**

(54) INTEGRATED CIRCUIT DESIGN METHOD FOR IMPROVED TESTABILITY

(75) Inventors: Takashi Nose, Kanagawa (JP); Hirobumi Furihata, Kanagawa (JP)

(73) Assignee: Synaptics Display Devices GK, Tokyo (JP)

( * ) Notice: Subject to any disclaimer, the term of this patent is extended or adjusted under 35 U.S.C. 154(b) by 25 days.

This patent is subject to a terminal disclaimer.

(21) Appl. No.: 13/566,518

(22) Filed: Aug. 3, 2012

(65) Prior Publication Data

US 2012/0293525 A1 Nov. 22, 2012

Related U.S. Application Data

(63) Continuation of application No. 12/453,930, filed on May 27, 2009, now Pat. No. 8,279,230.

(30) Foreign Application Priority Data

May 28, 2008 (JP) ..... 2008-140179

(51) Int. Cl.
*G09G 3/36* (2006.01)

(52) U.S. Cl.
CPC ..... *G09G 3/3611* (2013.01); *G09G 2320/0252* (2013.01); *G09G 2320/0261* (2013.01); *G09G 2320/103* (2013.01); *G09G 2330/021* (2013.01); *G09G 2340/16* (2013.01)

(58) Field of Classification Search
CPC ..... G09G 2330/021
See application file for complete search history.

(56) References Cited

U.S. PATENT DOCUMENTS

| | | | | |
|---|---|---|---|---|
| 5,485,127 | A * | 1/1996 | Bertoluzzi et al. | 331/69 |
| 5,515,080 | A * | 5/1996 | Nakamura et al. | 345/534 |
| 5,844,533 | A * | 12/1998 | Usui et al. | 345/89 |
| 5,956,748 | A * | 9/1999 | New | 711/149 |
| 5,982,664 | A * | 11/1999 | Watanabe | 365/185.11 |
| 7,123,246 | B2 | 10/2006 | Nakatani et al. | |
| 7,586,485 | B2 | 9/2009 | Teshirogi et al. | |
| 7,742,065 | B2 | 6/2010 | Furihata et al. | |

(Continued)

FOREIGN PATENT DOCUMENTS

| | | | |
|---|---|---|---|
| CN | 1703650 | A | 11/2005 |
| JP | 4-365094 | A | 12/1992 |

(Continued)

OTHER PUBLICATIONS

Japanese Office Action dated Sep. 24, 2012 with an English translation.

(Continued)

*Primary Examiner* — David Zarka
*Assistant Examiner* — Phong Nguyen
(74) *Attorney, Agent, or Firm* — McGinn IP Law Group, PLLC

(57) ABSTRACT

A display device is provided with a display panel; and a display panel driver driving the display panel in response to externally-provided image data. The display panel driver includes a display memory for storing the image data, and is configured to perform overdrive processing on the image data read from the display memory. The display panel driver includes an overdrive processing control circuit detecting writing of the image data into the display memory to control operation and halt of a circuit used for the overdrive processing.

17 Claims, 8 Drawing Sheets

(56) References Cited

U.S. PATENT DOCUMENTS

| | | | | |
|---|---|---|---|---|
| 2003/0052708 | A1* | 3/2003 | Momtaz et al. | 326/37 |
| 2003/0061453 | A1* | 3/2003 | Cosky et al. | 711/154 |
| 2003/0218918 | A1* | 11/2003 | Nagashima | 365/200 |
| 2004/0080521 | A1* | 4/2004 | Nose et al. | 345/690 |
| 2005/0237316 | A1* | 10/2005 | Huang et al. | 345/204 |
| 2005/0253833 | A1* | 11/2005 | Teshirogi et al. | 345/204 |
| 2006/0103682 | A1 | 5/2006 | Kunimori et al. | |
| 2006/0152501 | A1* | 7/2006 | Furihata et al. | 345/204 |
| 2006/0290642 | A1 | 12/2006 | Kim et al. | |
| 2008/0001871 | A1* | 1/2008 | Abe | 345/87 |
| 2008/0106544 | A1* | 5/2008 | Lee et al. | 345/214 |
| 2008/0170087 | A1* | 7/2008 | Kim | 345/690 |
| 2008/0259059 | A1* | 10/2008 | De Greef | 345/204 |
| 2008/0304709 | A1 | 12/2008 | Huang et al. | |

FOREIGN PATENT DOCUMENTS

| | | | |
|---|---|---|---|
| JP | 2003-044011 | A | 2/2003 |
| JP | 2004-252102 | A | 9/2004 |
| JP | 2005-316369 | A | 1/2005 |
| JP | 2005-316369 | A | 11/2005 |
| JP | 2005-326633 | A | 11/2005 |
| JP | 2006-195170 | A | 7/2006 |
| JP | 2007-011364 | A | 1/2007 |
| TW | 200535727 | A | 11/2005 |

OTHER PUBLICATIONS

Chinese Office Action dated Apr. 19, 2012 with an English translation.

* cited by examiner

INTEGRATED CIRCUIT DESIGN METHOD FOR IMPROVED TESTABILITY

This application is a Continuation Application of U.S. patent application Ser. No. 12/453,930, filed May 27, 2009, now U.S. Pat. No. 8,279,230.

INCORPORATION BY REFERENCE

This application claims the benefit of priority based on Japanese Patent Application No. 2008-140179, filed on May 28, 2008, the disclosure of which is incorporated herein by reference.

BACKGROUND OF THE INVENTION

1. Field of the Invention

The present invention relates to a display device, a display panel driver, a method for driving a display panel, and a method for supplying image data to the driver, and more specifically, to overdriving of the display panel.

2. Description of the Related Art

The overdriving is one approach for improving the response speed of liquid crystal material within a liquid crystal display panel. The overdriving is a technique for improving the response speed of a liquid crystal display panel by driving liquid crystal material with a drive voltage higher than a normal drive voltage for positive drive voltage or with a drive voltage lower than a normal drive voltage for negative drive voltage, when there is a large change in the grayscale level. FIG. 1 shows an exemplary response of liquid crystal material when not using the overdriving, and FIG. 2 shows an exemplary response of the liquid crystal material when using the overdriving. The response speed of liquid crystal material is about 20 to 30 ms for black and white display, and may exceed 100 ms for grayscale display, while the current frame frequency is about 60 Hz (that is, one frame period is 16.7 ms). Therefore, as shown in FIG. 1, the brightness of a pixel actually varies over multiple frame periods with a normal driving method, when the grayscale level is to be largely changed. On the other hand, the use of the overdriving effectively accelerates the response of the liquid crystal material and thereby to shorten the actual variation time of the brightness after the grayscale level change is required, as shown in FIG. 2.

Such overdriving is often used in large-sized liquid crystal display devices, for example, a liquid crystal television and a liquid-crystal monitor for a computer, which are required to display high-quality video images. For example, Japanese Open Laid Patent Application No. H04-365094 discloses a liquid crystal television that adopts the overdriving. FIG. 3 is a block diagram showing the circuit configuration of the liquid crystal television disclosed in this patent application. The disclosed liquid crystal television is provided with an antenna 101, a tuner 102, a TV linear circuit 103, an A/D convertor circuit 104, a sync control circuit 105, a segment electrode driver circuit 106, a common electrode driver circuit 107, a liquid crystal panel 108, an image memory 111, and a ROM 112. The image memory 111 stores image data of one frame. The ROM 112 stores an image data table corresponding to two image data inputs: one is image data of current frame and the other is image data of the previous frame read from the image memory 111. When the image data changes, optimum image data are obtained from the ROM 112 according to the direction and degree of the grayscale level change, and the liquid crystal panel 108 is driven in response to the image data read from the ROM 112.

In recent years, a demand for displaying moving images is increasing also in the portable terminals; video and TV functions are provided for portable terminals. Therefore, it is one prevalent choice to apply the overdriving to liquid crystal display devices of the portable terminals.

According to inventors' examination, however, the use of conventional overdriving may cause a problem in terms of power consumption, especially in portable devices which require low power consumption. In the conventional overdriving, overdrive processing is performed in every frame period, which involves: writing image data into the image memory 111 for storing the image data of the previous frame; reading the image data of the previous frame from the image memory 111 in order to compare it with the image data of a current frame; determining the degree of overdrive from the data stored in the ROM 112; and outputting the resultant drive data. Performing such overdrive processing in every frame period undesirably increases power consumption.

SUMMARY

The inventors have discovered that it is not necessary to perform overdrive processing in every frame period, when driving a liquid crystal display panel with an LCD panel driver which incorporates a display memory for storing image data of a previous frame image. It is not necessary to perform overdrive processing, when image data stored in the display memory are not updated; the image is unchanged in this case. It is possible to reduce power consumption by skipping overdrive processing when the image data in the display memory are unchanged.

More specifically, in an aspect of the present invention, a display device is provided with a display panel, and a display panel driver driving the display panel in response to externally-provided image data. The display panel driver is provided with a display memory for storing the externally-provided image data, and configured to perform overdrive processing on the image data read from the display memory. The display panel driver includes an overdrive processing control circuit which detects whether or not image data are written onto the display memory, to allow or prohibit the operation of a circuitry used for the overdrive processing.

The present invention effectively reduces the power consumption necessary for performing overdrive processing.

BRIEF DESCRIPTION OF THE DRAWINGS

The above and other objects, advantages and features of the present invention will be more apparent from the following description of certain preferred embodiments taken in conjunction with the accompanying drawings, in which.

DESCRIPTION OF PREFERRED EMBODIMENTS

The invention will be now described herein with reference to illustrative embodiments. Those skilled in the art will recognize that many alternative embodiments can be accomplished using the teachings of the present invention and that the invention is not limited to the embodiments illustrated for explanatory purposes.

Figure 1:
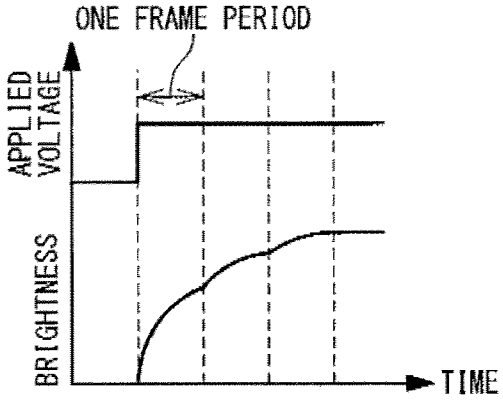
FIG. 1 is a graph showing an exemplary response of liquid crystal material in a normal operation (namely, when overdriving is not performed)
Figure 2:
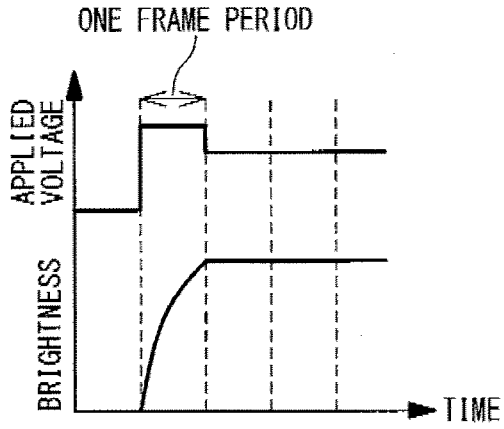
FIG. 2 is a graph showing an exemplary response of liquid crystal material in the case where overdriving is performed.
Figure 3:
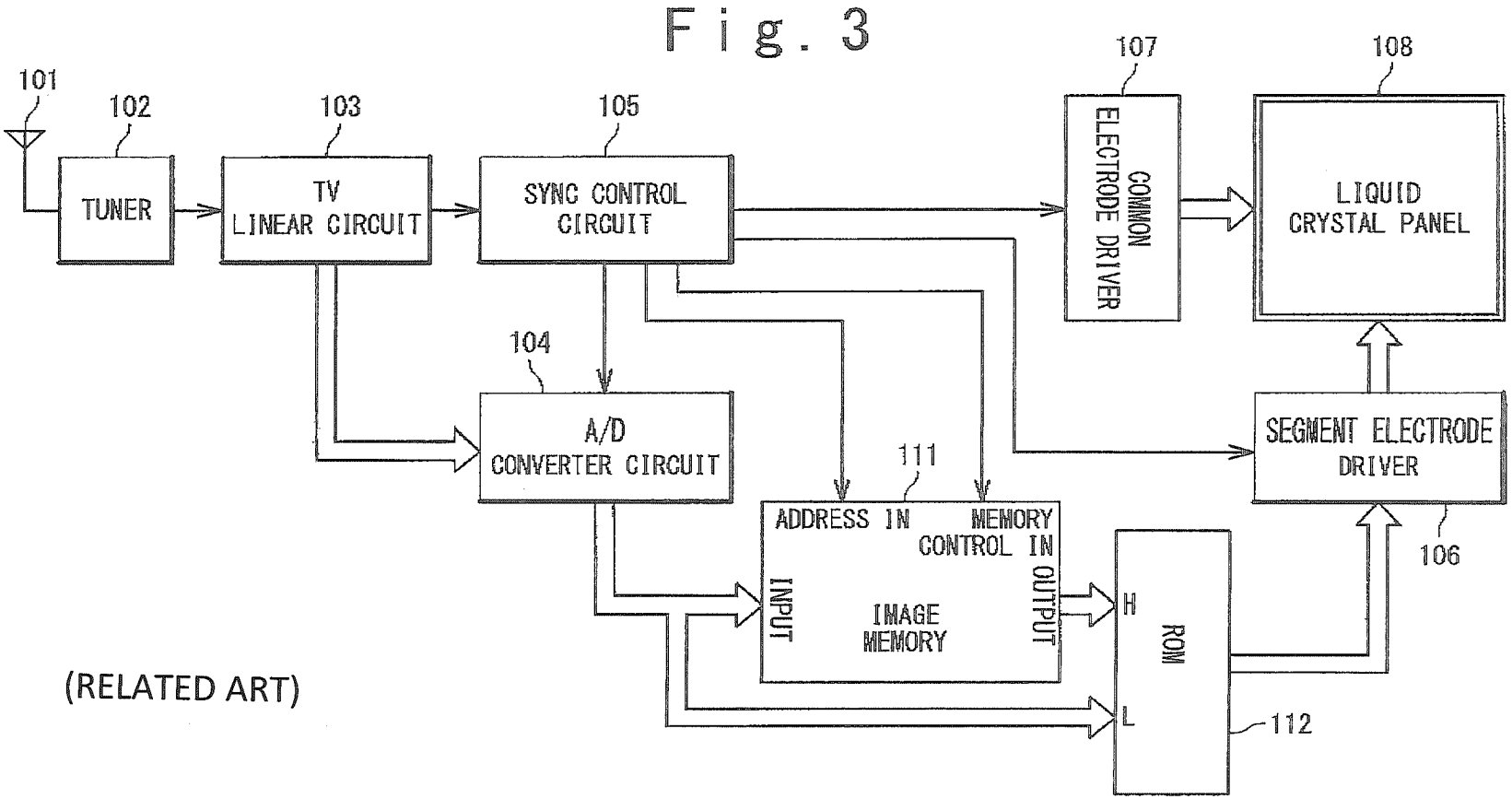
Fig. 3 (RELATED ART)
FIG. 3 is a block diagram showing the configuration of the conventional liquid crystal television adapted to overdriving.
Figure 4:
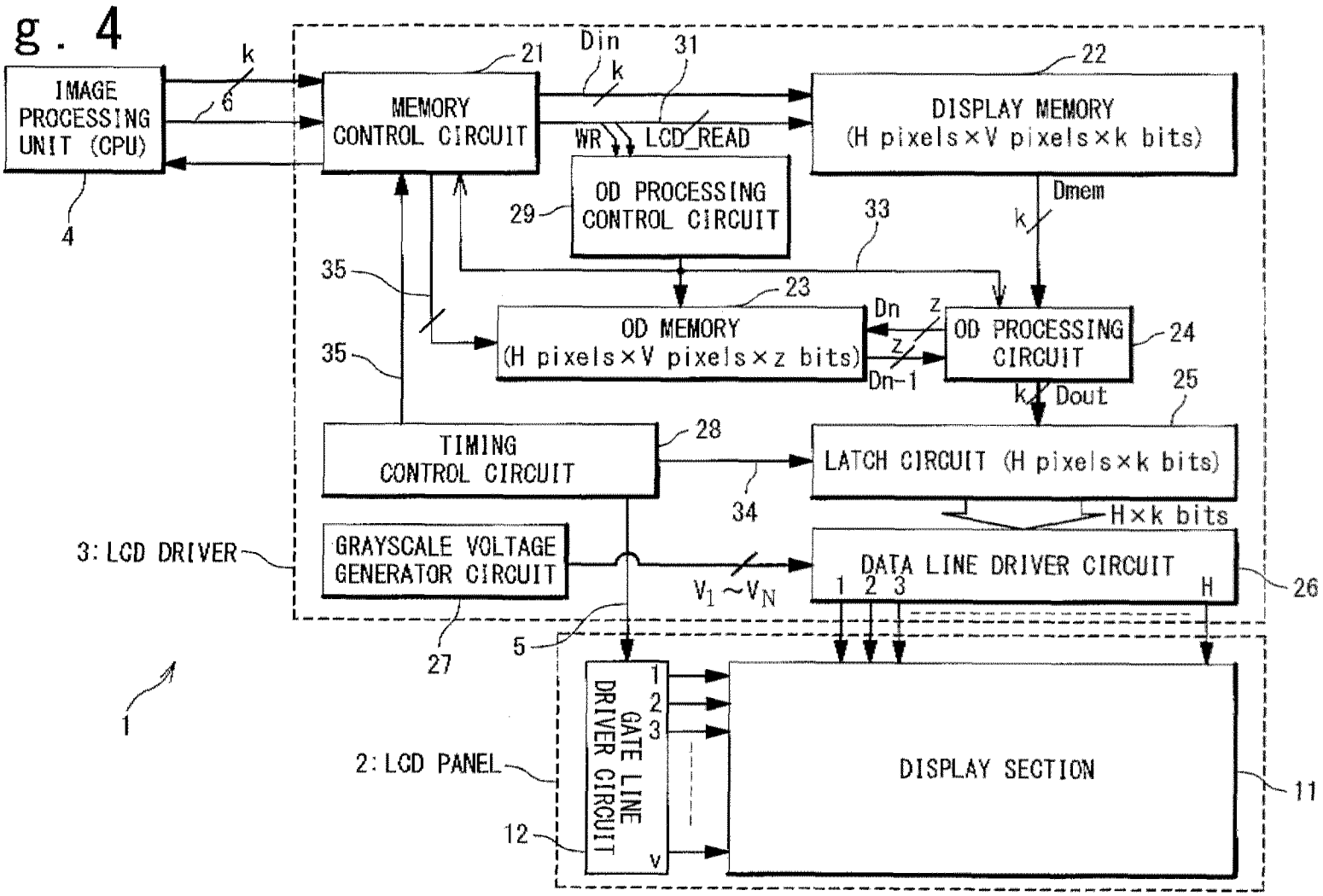
FIG. 4 is a block diagram showing an exemplary configuration of a liquid crystal display device in one embodiment of the present invention.

FIG. 4 is a block diagram showing an exemplary configuration of a liquid crystal display device 1 in one embodiment of the present invention. The liquid crystal display device 1 of this embodiment is configured to display images in response to image data Din supplied from an image processing device 4. The liquid crystal display device 1 is provided with a liquid crystal display panel 2 and an LCD driver 3.

The liquid crystal display panel 2 is provided with a display section 11 and a gate line driver circuit 12 formed by using a SOG (silicon on glass) technique. The display section 11 includes H data lines, V gate lines, and liquid crystal pixels arranged at the intersections of the data lines and gate lines. In this embodiment, the number of the liquid crystal pixels provided in the display section 11 is H×V. The gate line driver circuit 12 has a function of driving the V gate lines provided in the display section 11.

The LCD driver 3 drives the data lines within the display section 11 of the liquid crystal display panel 2 in response to the image data Din fed from the image processing device 4. The LCD driver 3 further generates gate line drive timing control signals 5 to control operation timings of the gate line driver circuit 12.

The image processing device 4 supplies to the LCD driver 3 the image data Din and memory control signals 6 for controlling the LCD driver 3. The memory control signals 6 include a write clock WR generated in synchronization with the transfer of the image data Din. The write clock WR is used for writing the image data Din into a display memory incorporated within the LCD driver 3, as will be described later. Timings at which the image processing device 4 supplies the image data Din and the write clock WR to the LCD driver 3 are in synchronization with a display frame timing signal Vsync supplied to the image processing device 4 from the LCD driver 3. That is, the image processing device 4 recognizes from the display frame timing signal Vsync the timings at which the image data Din and the write clock WR are to supplied, and supplies the image data Din and the write clock WR to the LCD driver 3 accordingly. A CPU (central processing unit) or a DSP (digital signal processor) may be used as the image processing device 4, for example.

The LCD driver 3 is provided with a memory control circuit 21, a display memory 22, an overdrive memory (OD memory) 23, an overdrive processing circuit 24, a latch circuit 25, a data line driver circuit 26, a grayscale voltage generator circuit 27, and a timing control circuit 28.

The memory control circuit 21 operates as follows: First, the memory control circuit 21 receives the image data Din from the image processing device 4 and transfers the received image data Din to the display memory 22. Second, the memory control circuit 21 is responsive to a timing control signal 35 received from the timing control circuit 28 for supplying display memory control signals 31 to the display memory 22 and for supplying overdrive memory control signals 32 to the overdrive memory 23. The display memory control signals 31 include the above-mentioned write clock WR and a read clock LCD_READ. The write clock WR is used for writing the image data Din into the display memory 22, and the read clock LCD_READ is used for reading the image data from the display memory 22. The frequency of the read clock LCD_READ is adjusted so that the image may be displayed on the display section 11 at a desired frame rate (typically, 60 Hz). On the other hand, the overdrive memory control signals 32 include the read clock LCD_READ. The write and read operations of the overdrive memory 23 are performed in synchronization with the read clock LCD_READ. Third, the memory control circuit 21 supplies the above-mentioned display frame timing signal Vsync to the image processing device 4. As described above, the display frame timing signal Vsync is used in order to determine the timings at which the image processing device 4 starts to supply the image data Din and the write clock WR.

The display memory 22 receives and stores the image data Din therein. Image data Dmem read from the display memory 22 are used for image display in the current frame. In this embodiment, the image data Din are k-bit data, and the display memory 22 has a capacity enough to store the image data for the H×V liquid crystal pixels, i.e., a capacity of H×V×k bits.

In this embodiment, a dual port memory is used as the display memory 22, and writing of the image data Din into the display memory 22 and reading of the image data Dmem from the display memory 22 are performed asynchronously. In detail, the writing of the image data Din into the display memory 22 is performed in synchronization with the write clock WR. The write clock WR is supplied to the LCD driver 3 only during a period in which the image data Din are written into the display memory 22. On the other hand, the reading of the image data Dmem from the display memory 22 is performed in synchronization with the read clock LCD_READ. Such a function is effective in improving flexibility of transfer of the image data Din to the display memory 22. For example, the configuration in which the writing and the reading are asynchronously performed allows omitting the transfer of the image data Din to the display memory 22, when there is no change in the image to be displayed. Moreover, in the case where only a part of the image is changed, such configuration allows selectively transferring only the part of the image data Din corresponding to the changed part to the display memory 22 with the write address of the display memory 22 specified.

Figure 5A:
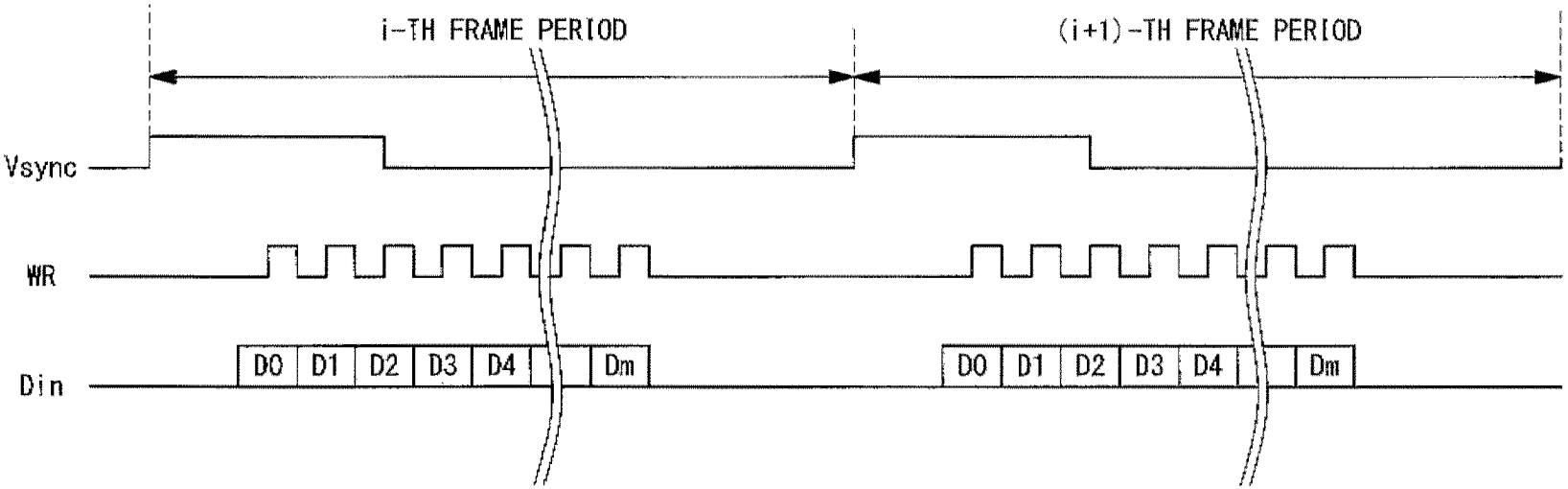
FIG. 5A is a diagram showing an exemplary image data transfer to a display memory.
Figure 5B:
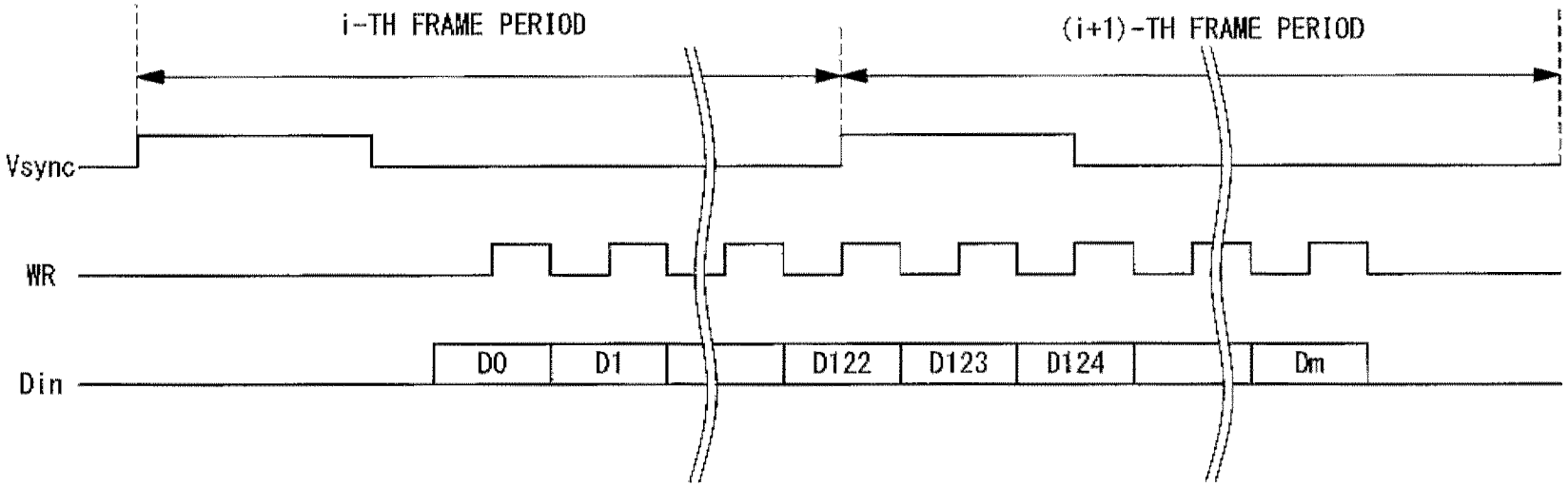
FIG. 5B is a diagram showing another exemplary image data transfer to the display memory.

FIGS. 5A and 5B are diagrams showing exemplary procedures of the data transfer of the image data Din to the display memory 22. When the transfer of the image data Din is started at a relatively early stage in a certain frame period, as shown in FIG. 5A, for example, this allows completing the transfer of the desired image data Din within the same frame period by using a relatively high-frequency clock as the write clock WR. According to such an operation, the image data Din transferred in a certain frame period can be used for image display of the same frame period. When the transfer of the image data Din is started after a lapse of a considerable time since the start of a certain frame period, on the other hand, the image data Din are transferred over the current frame period and the next frame period by using a relatively low-frequency clock as the write clock WR as shown in FIG. 5B. In FIG. 5B, the image data Din are transferred over the i-th and (i+1)-th frame periods. In such operation, the image data Din transferred over the i-th frame period and the (i+1)-th frame period are used for display of the image of the (i+1)-th frame period.

The configuration which allows asynchronously performing the writing of the image data Din into the display memory 22 and the reading of the image data Dmem from the display memory 22 is suitable for supporting both of the transfers of the image data Din showing FIGS. 5A and 5B.

Referring back to FIG. 4, the overdrive memory 23 is used to store the image data of the previous frame image. The overdrive memory 23 receives and stores upper z bits of the image data Dmem (the image data used for the image display on the display section 11) read from the display memory 22 through the overdrive processing circuit 24. It should be noted that the image data transferred from the display memory 22 to the overdrive memory 23 through the overdrive processing circuit 24 are denoted by the numeral $D_n$ in FIG. 4. The image data $D_n$ stored in the overdrive memory 23 in a certain frame period is supplied to the overdrive processing circuit 24 as the previous frame image data $D_{n-1}$ in the next frame period. The data access to the overdrive memory 23 is performed in synchronization with the read clock LCD_READ.

The overdrive processing circuit 24 has a function of performing overdrive processing in response to the previous frame image data $D_{n-1}$ (namely, the correction processing of the image data Dmem for achieving the overdriving) on the image data Dmem read from the display memory 22 to generate resultant image data Dout. The resultant image data Dout are transferred to the latch circuit 25. In addition, the overdrive processing circuit 24 transfers upper z bits of the image data Dmem (the image data used for the image display on the display section 11) received from the display memory 22 to the overdrive memory 23, and stores the upper z bits of the image data Dmem into the overdrive memory 23.

The latch circuit 25 is responsive to a latch signal 34 received from the timing control circuit 28 for latching the resultant image data Dout from the overdrive processing circuit 24 to transfer the resultant image data Dout to the data line driver circuit 26. The latch circuit 25 has a capacity for storing the resultant image data Dout associated with H pixels of one horizontal line, i.e., a capacity of H×k bits.

The data line driver circuit 26 drives data lines of the display section 11 of the liquid crystal display panel 2 in response to the resultant image data Dout of the selected horizontal line received from the latch circuit 25. More specifically, the data line driver circuit 26 selects a grayscale voltage from a plurality of grayscale voltages $V_1$ to $V_N$ fed from the grayscale voltage generator circuit 27 for each data line in response to the resultant image data Dout, and drives each data line of the display section 11 to the selected grayscale voltage. In this embodiment, the number of grayscale voltages supplied from the grayscale voltage generator circuit 27 is $2^k$.

The timing control circuit 28 provides a timing control for the whole of the LCD driver 3. In detail, the timing control circuit 28 generates the latch signal 34, the timing control signal 35, and the gate line driving timing control signal 5, and supplies these signals to the latch circuit 25, the memory control circuit 21, and the gate line driver circuit 12, respectively.

One feature of the liquid crystal display device 1 of this embodiment is that the liquid crystal display device 1 is configured to automatically perform execution and halt of the overdrive processing depending on whether or not the image data Din are transferred from the image processing device 4 to the LCD driver 3. This effectively reduces power consumption. In the case where the image data Din are not transferred from the image processing device 4 to the LCD driver 3, the image being displayed does not experience a change, and the overdrive processing is not essentially necessary. In such a case, the liquid crystal display device 1 of this embodiment halts the write and read operations into and from the overdrive memory 23 and thereby reduces power consumption, effectively.

More specifically, the LCD driver 3 of this embodiment is provided with an overdrive processing control circuit 29 that generates an overdrive processing select signal 33 to control the execution and halt of the overdrive processing. In this embodiment, the write clock WR is additionally supplied to the overdrive processing control circuit 29, and the overdrive processing control circuit 29 discriminates the existence or absence of the transfer of the image data Din from the write clock WR. According to the result of the discrimination, the overdrive processing control circuit 29 asserts the overdrive processing select signal 33 to permit the execution of the overdrive processing if necessary. The overdrive processing select signal 33 is fed to the overdrive memory 23 and the overdrive processing circuit 24.

When the overdrive processing select signal 33 is asserted, the overdrive processing is performed. That is, the image data Dn received from the display memory 22 are written into the overdrive memory 23 while the previous frame image data $D_{n-1}$ are read from the overdrive memory 23, and the overdrive processing circuit 24 performs the overdrive processing using the previous frame image data $D_{n-1}$.

When the overdrive processing select signal 33 is negated, on the other hand, the overdrive processing is halted. That is, the write and read operations into and from the overdrive memory 23 are halted: the overdrive processing circuit 24 outputs the image data Dmem received from the display memory 22 as they are, as the resultant image data Dout without performing the overdrive processing. The halt of the write and read operations into and from the overdrive memory 23 may be achieved by, for example, halting supply of the read clock LCD_READ to the overdrive memory 23. In order to prevent malfunction, it is preferable to halt the supply of the address signals and to negate the write enable signal and the read enable signal, in addition to the halt of the supply of the read clock LCD_READ.

Figure 6:
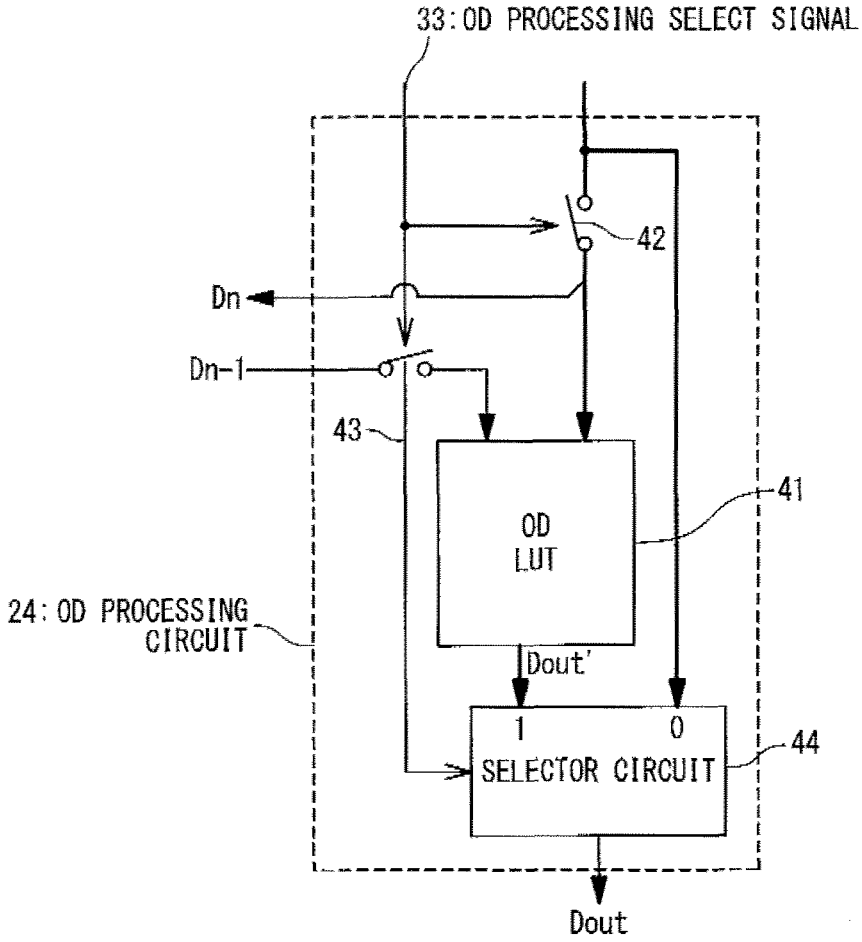
FIG. 6 is a block diagram showing an exemplary configuration of an overdrive processing circuit.

FIG. 6 is a block diagram showing an exemplary configuration of the overdrive processing circuit 24 for performing such an operation. In one embodiment, the overdrive processing circuit 24 is provided with an overdrive processing LUT (lookup table) 41, switches 42, 43, and a selection circuit 44. The overdrive processing LUT 41 describes an association of allowed values of the image data Dmem received from the display memory 22 and allowed values of the image data $D_{n-1}$ of the previous frame image received from the overdrive memory 23 with values of the output image data Dout'. The overdrive processing LUT 41 is configured to receive the image data Dmem of the current frame image from the display memory 22 through the switch 42, to receive the image data $D_{n-1}$ of the previous frame image from the overdrive memory 23 through the switch 43, and to output the image data Dout' corresponding to the image data Dmem and $D_{n-1}$. In response to the overdrive processing select signal 33, the selection circuit 44 outputs either one of the output image data Dout' or the image data Dmem as the resultant image data Dout.

When the overdrive processing select signal 33 is asserted, the switches 42 and 43 are turned on, and the selection circuit 44 selects the output image data Dout' as the resultant image data Dout. This allows performing the overdrive processing, and writing upper z bits of the image data Dmem of the current frame image into the overdrive memory 23 as the image data $D_n$. When the overdrive processing select signal 33 is negated, on the other hand, the switches 42 and 43 are turned off and the selection circuit 44 selects the image data Dmem as the resultant image data Dout. This allows halting the overdrive processing.

One issue in controlling the execution and halt of the overdrive processing is the selection of the frame period in which the overdrive processing is to be performed when the image data Din are transferred to the LCD driver 3. In the case where the image data Din are transferred in a certain frame period and the transferred image data Din are used for the image display in the same frame period, the overdrive processing is to be performed in the frame period in which the relevant image data Din are transferred; if not so, the response speed of liquid crystal material is not improved according to the change of the grayscale level. On the other hand, in the case where the image data Din are transferred in a certain frame period and the transferred image data Din are used for the image display in the frame period following the certain frame period, the overdrive processing is to be performed in the next frame period; if not so, the overdrive processing is performed on the image data which is being updated, and an improper image may be displayed.

In this embodiment, the overdrive processing control circuit 29 is configured to properly determine the frame period in which the overdrive processing should be performed, from the relation between the timing at which the transfer of the image data Din is started and the timing at which reading of the image data Dmem from the display memory 22 is started. The overdrive processing control circuit 29 recognizes the timing at which the transfer of the image data Din is started by the timing at which the supply of the write clock WR is started, and recognizes the timing at which the reading of the image data Dmem from the display memory 22 is started by the timing at which the supply of the read clock LCD_READ is started. When the timing at which the transfer of the image data Din is started is ahead of the timing at which the reading of the image data Dmem from the display memory 22 is started in a specific frame period, the image data Din transferred in the frame period is used for the image display in the specific frame period. In this case, the overdrive processing control circuit 29 permits the overdrive processing in the specific frame period. On the other hand, when the timing at which the transfer of the image data Din is started is behind the timing at which the reading of the image data Dmem from the display memory 22 is started in a certain frame period, the transferred image data Din are used for the image display in the frame period following the specific frame period. In this case, the overdrive processing control circuit 29 permits the overdrive processing in the following frame period.

More specifically, the overdrive processing control circuit 29 performs the following processes, using a CPU write flag as an internal variable in this embodiment:

(a) When the supply of the write clock WR is started, the overdrive processing control circuit 29 asserts the CPU write flag.

(b) When the supply of the read clock LCD_READ is started in the state where the CPU write flag is asserted, the overdrive processing control circuit 29 asserts the overdrive processing select signal 33.

(c) When a predetermined period elapses after the overdrive processing select signal 33 is asserted, the overdrive processing control circuit 29 negates the CPU write flag.

(d) When the supply of the read clock LCD_READ is terminated, the overdrive processing control circuit 29 negates the overdrive processing select signal 33.

The above-described procedure allows appropriately determining the frame period in which the overdrive processing is to be performed. In the following, a detailed description is given of an exemplary procedure for determining the frame period in which the overdrive processing is to be performed.

Figure 7:
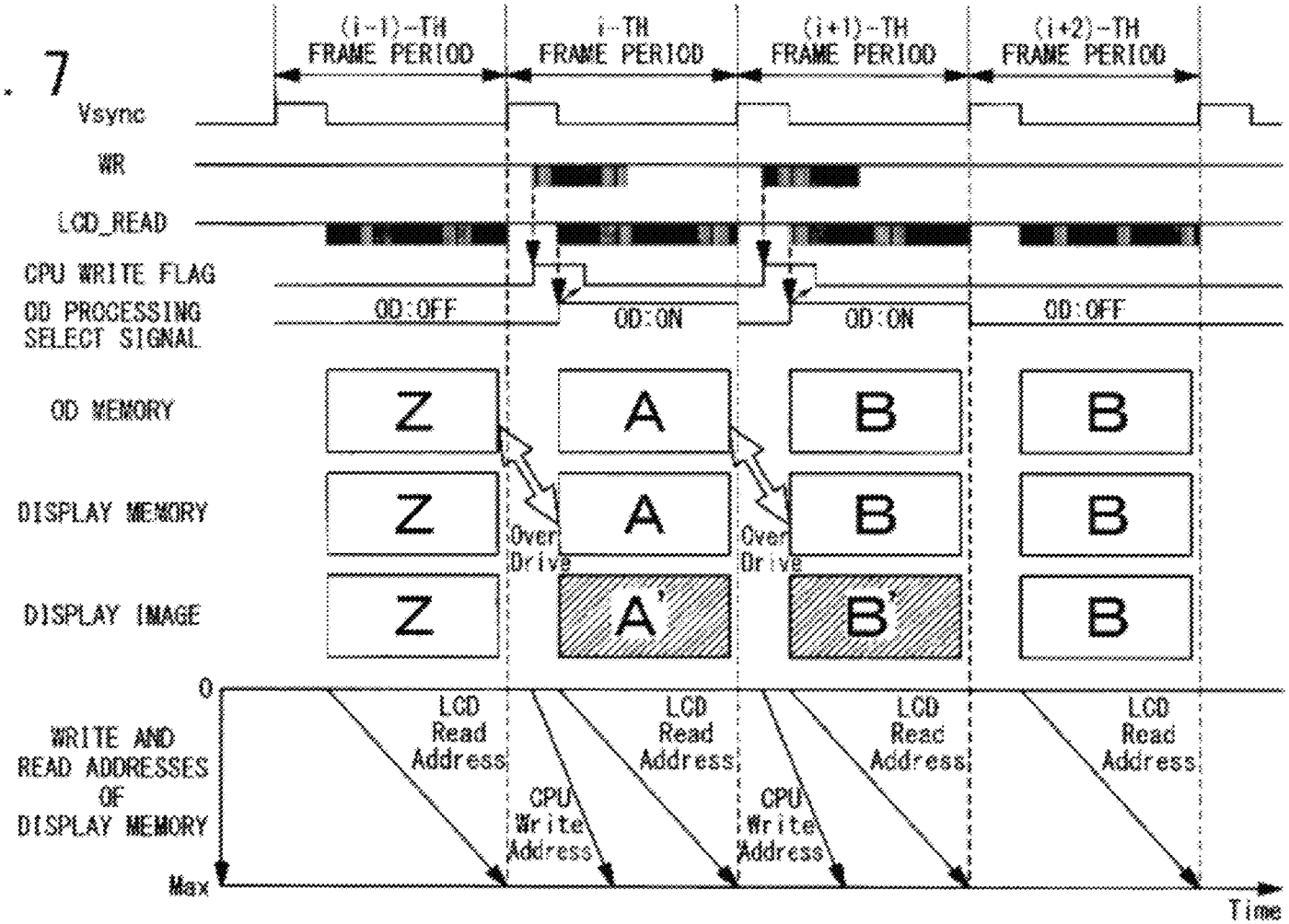
FIG. 7 is a block diagram showing an exemplary operation of the liquid crystal display device in one embodiment of the present invention.

FIG. 7 is a diagram showing an operation of the liquid crystal display device 1 in the case where the timing at which the transfer of the image data Din is started is ahead of the timing at which the reading of the image data Dmem from the display memory 22 is started. In FIG. 7, the symbols "A," "B," and "Z" denote images, respectively, and the symbols "A'" and "B'" denote images obtained by performing the overdrive processing on the images "A" and "B," respectively.

The image processing device 4 monitors the display frame timing signal Vsync, and transfers the image data Din so that the read address of the image data Dmem in the display memory 22 does not overtake the write address of the image data Din. In detail, in the i-th frame period, the image processing device 4 starts the transfer of the image data Din and the supply of the write clock WR in synchronization with the transfer, at a timing before the supply of the read clock LCD_READ is started. The frequency of the write clock WR is adjusted higher than the frequency of the read clock LCD_READ and this prevents the read address of the image data Dmem from overtaking the write address of the image data Din. It should be noted, however, the frequency of the write clock WR is not necessarily required to be higher than the frequency of the read clock LCD_READ, in the case where the image data Din corresponding to only a part of the image are transferred.

When the supply of the write clock WR is started, the CPU write flag is asserted. Subsequently, the supply of the read clock LCD_READ is started and the reading of the image data Dmem from the display memory 22 is started. When the supply of the read clock LCD_READ is started in the state where the CPU write flag is asserted, the overdrive processing select signal 33 is asserted and the execution of the overdrive processing is permitted. When the predetermined period elapses after the overdrive processing select signal 33 is asserted, the CPU write flag is negated. Subsequently, the overdrive processing select signal 33 is negated when the supply of the read clock LCD_READ is halted. In such an operation, the overdrive processing is performed in the i-th frame period, when the transfer of the image data Din is performed in the i-th frame period.

On the other hand, the overdrive processing is not performed in the frame period in which the transfer of the image data Din to the display memory 22 is not performed. That is, neither the write operation nor the read operation to the overdrive memory 23 is performed. This effectively reduces the power consumption.

Figure 8:
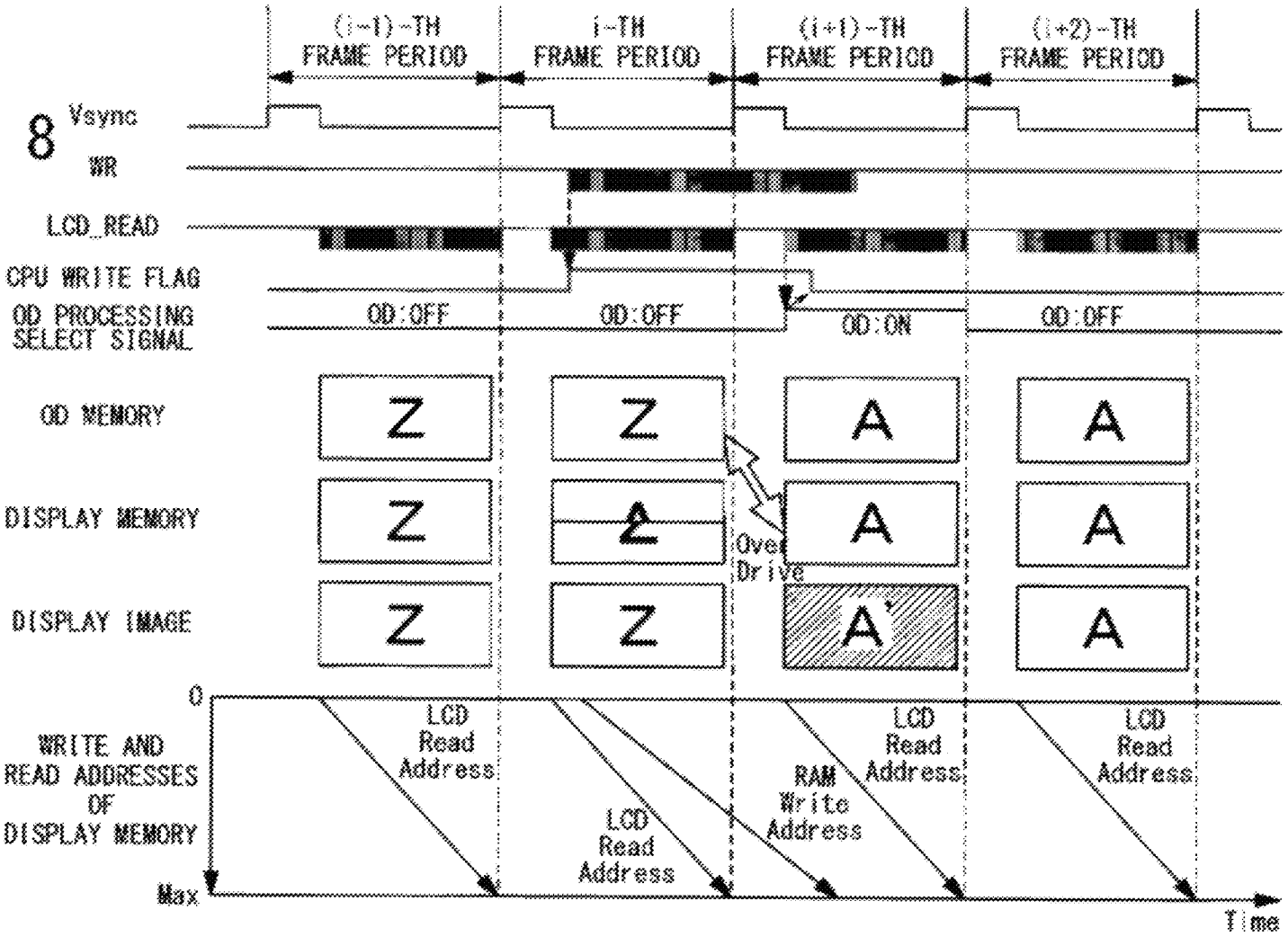
FIG. 8 is a block diagram showing another exemplary operation of the liquid crystal display device in one embodiment of the present invention.

FIG. 8 is a diagram showing an operation of the liquid crystal display device 1 in the case where the timing at which the transfer of the image data Din is started is behind the timing at which the reading of the image data Dmem from the display memory 22 is started. In the operation of FIG. 8, the transfer of the image data Din to the display memory 22 is performed over the i-th frame period and the (i+1) th frame period.

In each frame period, the supply of the read clock LCD_READ is started at the predetermined timing after the display frame timing signal Vsync is asserted, and the reading of the image data Dmem from the display memory 22 is started. At this time, the overdrive processing select signal 33 remains negated, since the CPU write flag is not asserted at the timing of the start of the supply of the read clock LCD_READ of the i-th frame period. That is, the overdrive processing is not performed in the i-th frame period.

The image processing device 4 monitors the display frame timing signal Vsync, and transfers the image data Din so that the write address of the image data Din does not overtake the read address of the image data Dmem in the display memory 22. It should be noted that the relation of the write address and the read address in the operation of FIG. 8 is in reverse order to the operation of FIG. 7.

In detail, the image processing device 4 starts the transfer of the image data Din and the supply of the write clock WR in synchronization with the transfer of the image data Din in the i-th frame period, at a timing after the supply of the read clock LCD_READ is started. The frequency of the write clock WR is set lower than the frequency of the read clock LCD_READ and this prevents the write address of the image data Din from overtaking the read address of the image data Dmem. It should be noted, however, the frequency of the read clock LCD_READ is not necessarily required to be lower than the frequency of the write clock WR in the case where the image data Din associated with only a part of the image is transferred. When the supply of the write clock WR is started, the CPU write flag is asserted.

In the following (i+1)-th frame period, when the supply of the read clock LCD_READ is started, the overdrive processing select signal 33 is asserted to permit the execution of the overdrive processing in response to the CPU write flag being asserted. When the predetermined period elapses after the overdrive processing select signal 33 is asserted, the CPU write flag is negated. Subsequently, the overdrive processing select signal 33 is negated, when the supply of the read clock LCD_READ is halted. In such the operation, the overdrive processing is performed in the (i+1)th frame period, when the transfer of the image data Din is started in the i-th frame period. Therefore, the overdrive processing is performed after a complete set of the image data is prepared on the display memory 22, and this effectively avoids an improper image being displayed.

In the frame period in which the transfer of the image data Din to the display memory 22 is not performed, the overdrive processing is not performed. That is, neither the write operation nor the read operation to the overdrive memory 23 is performed, and this effectively reduces power consumption.

As thus described, the operation of the overdrive processing control circuit 29 of this embodiment allows automatically identifying the transfer of the image data Din shown in FIG. 7 and the transfer of the image data Din shown in FIG. 8, and appropriately selecting the frame period in which the overdrive processing is to be performed.

Such operation is preferable, especially when the timing relation is adjustable between the timing at which the transfer of the image data Din to the display memory 22 is started (namely, the timing at which the supply of the write clock WR is started) and the timing at which the reading of the image data Dmem from the display memory 22 is started (namely, the timing at which the supply of the read clock LCD_READ is started). In one embodiment, the timing relation may be adjusted in response to the amount of the image data Din to be transferred. For example, when the quantity of the image data Din to be transferred is smaller than a predetermined value, the image processing device 4 adjusts the timing at which the transfer of the image data Din to the display memory 22 is started to precede the timing at which the reading of the image data Dmem from the display memory 22 is started. In this case, the image display in accordance with the transferred image data Din is performed in the same frame period as the frame period in which the transfer of the image data Din is started, while the overdrive processing is performed in the same frame period. When the quantity of the image data Din that should be transferred is larger than a specified value, on the other hand, the image processing device 4 adjusts the timing at which the transfer of the image data Din to the display memory 22 is started to come after the timing at which the reading of the image data Dmem from the display memory 22 is started. The image display in accordance with the image data Din transferred is performed in the frame period following the frame period in which the transfer of the image data Din is started, while the overdrive processing is performed in the following frame period.

Although various embodiments of the present invention are described above, the present invention should not be interpreted as being limited to the embodiments described above. The present invention may be modified and implemented in various forms. Especially, although embodiments in which the present invention is applied to a liquid crystal display device are presented above, it would be obvious to those skilled in the art that the present invention is applicable to other display devices that perform the overdrive processing, for example, electronic paper (especially, electronic paper using electro-liquid powder).

What is claimed is:

1. A display device, comprising:

a display panel; and a display panel driver driving said display panel in response to externally-provided image data, wherein said display panel driver includes:

a display memory which stores said externally-provided image data as current frame image data corresponding to an image of a current frame, said externally-provided image data being written into said display memory in a synchronization with a write clock;

an overdrive memory which receives and stores at least a portion of said image data stored in said display memory as previous frame image data corresponding to an image of a previous frame;

an overdrive processing circuit configured to perform an overdrive processing on said current frame image data read from said display memory, in response to said previous frame image data, to generate resultant image data;

a drive circuit driving said display panel in response to said resultant image data; and an overdrive processing control circuit detecting writing of said externally-provided image data into said display memory, by monitoring an activity of said write clock, and wherein said overdrive processing control circuit is responsive to the activity of said write clock for each frame for allowing and prohibiting a write operation of said previous frame image data into said overdrive memory, a read operation of said previous frame image data from said overdrive memory, and said overdrive processing performed by said overdrive processing circuit.

2. The display device according to claim 1, wherein reading of said image data from said display memory and reading of said previous frame image data from said overdrive memory are performed in synchronization with a read clock, and wherein said overdrive processing control circuit is configured:

to assert a write flag when supply of said write clock is started;

to assert an overdrive processing select signal for said allowing said write operation of said previous frame image data into said overdrive memory, said read operation of said previous frame image data from said overdrive memory, and said overdrive processing by using said overdrive processing circuit, when a supply of said read clock is started with said write flag asserted;

to negate said write flag when a predetermined period expires after said overdrive processing select signal is asserted; and to negate said overdrive processing select signal when a supply of said read clock is terminated in each frame period.

3. The display device according to claim 1, said overdrive processing control circuit detecting said write operation of said image data into said display memory thereby providing an automatic control of said overdrive processing for each frame of image data.

4. The display device according to claim 1, wherein said write clock is fed to said display memory.

5. The display device of claim 1, wherein said display memory comprises a dual port memory having a capability of writing image data into the display memory asynchronously from reading of image data from the display memory.

6. The display device according to claim 1, wherein the read operation from said overdrive memory is performed in a synchronization with a read clock fed to said overdrive memory, and wherein the read operation from said overdrive memory is prohibited in response to the activity of said write clock through a stopping of a feeding of said read clock to said overdrive memory.

7. A display panel driver for driving a display panel in response to externally-provided image data, said display panel driver comprising:

a display memory which stores said externally-provided image data as current frame image data corresponding to an image of a current frame, said externally-provided image data being written into said display memory in a synchronization with a write clock;

an overdrive memory which receives and stores at least a portion of said image data stored in said display memory as previous frame image data corresponding to an image of a previous frame;

an overdrive processing circuit configured to perform an overdrive processing on said current frame image data read from said display memory in response to said previous frame image data to generate resultant image data;

a drive circuit driving said display panel in response to said resultant image data; and an overdrive processing control circuit detecting writing of said externally-provided image data into said display memory, by monitoring an activity of said write clock, wherein said overdrive processing control circuit is responsive to the activity of said write clock for each frame for allowing and prohibiting a write operation of said previous frame image data into said overdrive memory, a read operation of said previous frame image data from said overdrive memory, and said overdrive processing performed by said overdrive processing circuit.

8. The display panel driver according to claim 7, wherein reading of said image data from said display memory and reading of said previous frame image data from said overdrive memory are performed in synchronization with a read clock, and wherein said overdrive processing control circuit is configured:

to assert a write flag when supply of said write clock is started;

to assert an overdrive processing select signal for allowing writing of said previous frame image data into said overdrive memory, reading of said previous frame image data from said overdrive memory, and said overdrive processing by using said overdrive processing circuit, when supply of said read clock is started with said write flag asserted;

to negate said write flag when a predetermine period expires after said overdrive processing select signal is asserted; and to negate said overdrive processing select signal when supply of said read clock is terminated in each frame period.

9. The display panel driver according to claim 7, said overdrive processing control circuit detecting said write operation of said externally-provided image data into said display memory thereby providing an automatic control of said overdrive processing for each frame of image data.

10. The display panel driver according to claim 7, wherein said write clock is fed to said display memory.

11. The display panel drive of claim 7, wherein said display memory comprises a dual port memory having a capability of writing image data into the display memory asynchronously from reading of image data from the display memory.

12. The display panel driver according to claim 7, wherein the read operation from said overdrive memory is performed in a synchronization with a read clock fed to said overdrive memory, and wherein the read operation from said overdrive memory is prohibited in response to the activity of said write clock through a stopping of a feeding of said read clock to said overdrive memory.

13. A display panel drive method, comprising:

storing image data as current frame image data corresponding to an image of a current frame into a display memory in a synchronization with a write clock;

storing into an overdrive memory at least a portion of said image data stored in said display memory as previous frame image data corresponding to an image of a previous frame;

performing an overdrive processing on said current frame image data read from said display memory in response to said previous frame image data to generate resultant image data;

driving said display panel in response to said resultant image data;

detecting a writing of said externally-provided image data into said display memory, by monitoring an activity of said write clock; and in response to the activity of said write clock for each frame, allowing and prohibiting a write operation of said previous frame image data into said overdrive memory, a read operation of said previous frame image data from said overdrive memory, and said overdrive processing.

14. The display panel drive method according to claim 13, wherein said detecting the writing of said externally-provided thereby provides an automatic control of said overdrive processing for each frame of image data.

15. The display panel drive method according to claim 13, wherein said write clock is fed to said display memory.

16. The display panel drive method according to claim 13, wherein said display memory comprises a dual port memory having a capability of writing image data into the display memory asynchronously from reading of image data from the display memory.

17. The display panel drive method according to claim 13, wherein the read operation from said overdrive memory is performed in a synchronization with a read clock fed to said overdrive memory, and wherein the read operation from said overdrive memory is prohibited in response to the activity of said write clock through a stopping of a feeding of said read clock to said overdrive memory.

* * * * *